United States Patent [19]

Fellows et al.

[11] Patent Number: 4,726,914

[45] Date of Patent: Feb. 23, 1988

[54] CORROSION INHIBITORS

[75] Inventors: Larry A. Fellows; Paul E. Eckler, both of Terre Haute, Ind.

[73] Assignee: International Minerals & Chemical Corp., Terre Haute, Ind.

[21] Appl. No.: 917,699

[22] Filed: Oct. 10, 1986

[51] Int. Cl.[4] ..... C23F 11/14

[52] U.S. Cl. ..... 252/392; 252/8.555; 422/16

[58] Field of Search ..... 252/8.555, 392, 396; 422/14, 16

[56] References Cited

U.S. PATENT DOCUMENTS

| | | | |
|---|---|---|---|
| 1,992,689 | 2/1935 | Cox | 252/392 X |
| 2,688,368 | 9/1954 | Rodgers et al. | 252/8.555 X |
| 3,201,349 | 8/1965 | Quanstrom | 252/392 X |
| 4,350,606 | 9/1982 | Cuisia et al. | 252/392 |
| 4,452,758 | 6/1984 | Wilson et al. | 252/392 X |
| 4,552,686 | 11/1985 | Morris-Sherwood et al. | 252/392 |

*Primary Examiner*—Herbert B. Guynn

*Attorney, Agent, or Firm*—Robert H. Dewey; Thomas L. Farquer

[57] ABSTRACT

A corrosion inhibitor for mild steel comprising the combination of trimethylolethane or trimethylolpropane with a disclosed alkanolamine.

9 Claims, No Drawings

CORROSION INHIBITORS

This invention relates to corrosion inhibitors. In a particular aspect this invention relates to a combination which is effective for protecting mild steel from corrosioon.

A corrosion inhibitor is a chemical substance which, when added in small concentrations to an environment, effectively checks, decreases, or prevents the reaction of a metal with the environment. Different classifications of inhibitors include passivators, precipitators, vapor phase, cathodic, anodic, neutralizing, and absorbants. Corrosion can occur as a general attack, a localized pitting, or in an intensely concentrated area such as in stress cracking and may occur in many different media.

The effectiveness of a corrosion inhibitor is judged by different criteria. The amount of the corrosion inhibitor required is an important characteristic for the corrosion inhibitor. The better an inhibitor is, the smaller the concentration required for it to be effective. The amount of corrosion that it prevents or retards is also a major consideration. The better protected the metal, the more valuable the inhibitor. The primary consideration in evaluating the effectiveness of the corrosion inhibitor is how well the inhibitor protects the metal.

Nitrites have proven successful in the past as corrosion inhibitors. The method employed by the experiment used a solution of triethanolamine and sodium nitrite as a standard for performance evaluation. The use of nitrites, however, is undesirable because they tend to form nitrosamines, which are potential carcinogens.

In oil field technology, mild steel is used extensively as a construction material, even though crude oil can be highly corrosive. To protect the iron and steel employed, organic inhibitors are used. Commonly used organic inhibitors include acetylenic alcohols, imidazolines, and quaternary ammonium compounds.

The solubility of the organic inhibitor is one of the most important properties, for the inhibitor should exhibit sufficient solubility to be delivered to the metal in low concentration.

Although many corrosion inhibitors have been used in the past, there is a continuing need for low-cost inhibitors.

SUMMARY OF THE INVENTION

It is an object of this invention to provide corrosion inhibitors.

It is another object of this invention to provide a combination effective for protecting mild steel from corrosion.

It is yet another object of this invention to provide a method for protecting mild steel from corrosion.

Other objects of this invention will be apparent to those skilled in the art from the description herein.

It is the discovery of this invention to provide a corrosion inhibitor for mild steel comprising the combination of a polyol represented by the formula

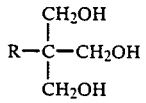

where R is methyl or ethyl with an alkanolamine represented by the formula

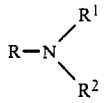

where R can be $HOCH_2CH_2$— or $H_3C$—CHOH—$CH_2$—; $R^1$ can be H, $CH_3$ or $HOCH_2CH_2$—; and $R^2$ can be H, $CH_3$— or $HOCH_2CH_2$—, and $R^1$ and $R^2$ can be the same or different.

DETAILED DESCRIPTION

The polyols and alkanolamines useful in the practice of this invention are old in the art and are commercially available at moderate cost. The commercial grade materials are suitable for the practice of this invention.

In preparing the combinations of this invention it is convenient to mix the components without added water and it can be supplied to the ultimate user in this form. It is then disolved in water to which the steel will be exposed to provide a concentration of about 1% by weight. The concentration is not critical however, but it is contemplated that the most useful concentration will be from 0.5% to 1.5%. The polyol and the amine are in a mole ratio of 0.8 to 1.2.

The polyols of the present invention include trimethylolethane (TME) and trimethylolpropane. It is contemplated that other polyols are also useful and may be regarded as the practical equivalents thereof. TME is the preferred polyol.

The alkanolamines of this invention include but are not limited to monoethanolamine, diethanolamine, triethanolamine, N,N-dimethyl-ethanolamine and dimethylamino-2-propanol. The preferred alkanolamine is diethanolamine.

The invention will be better understood with reference to the following examples. It is understood however that the examples are intended only to illustrate the invention and it is not intended that the invention be limited thereby.

EXAMPLE 1

An equimolar mixture of trimethylolethane and diethanolamine was prepared and tested by the stacked steel test, as is known. An aqueous solution containing 1% by weight of the mixture and having a water hardness of 125 ppm of Ca was then prepared and used in the test.

Mild steel slugs 1.5–1.75 inches long and 1 inch in diameter were used as the test material. All surfaces except one end were coated with an epoxy paint. The exposed test end of each slug was polished with a power grinding wheel, then was covered with about 1 g. of solution. The exposed end of second steel slug was placed over the test end to spread the film and prevent evaporation. The stacked steel slugs were then placed in an equillibrated desiccator over water.

A mixture of sodium nitrite and triethanolamine was used as a standard corrosion inhibitor as a control in each test. Also diethanolamine alone was employed as a control. Performance of the test solutions was judged by visual examination compared to the performance of the controls. Each solution was tested in triplicate; one was examined after about 24 hours and the other two after approximately 4 days.

The results of the tests showed that diethanolamine alone showed no corrosion protection. However the combination with trimethyolethane (TME) showed corrosion protection.

EXAMPLE 2

The experiment of example 1 was repeated in all essential details except that various alkanolamines were substituted for the diethanolamine:

| Ex. No. | Alkanolamine |
|---|---|
| 2 | Dimethylamino-2-propanol |
| 3 | Dimethylethanolamine |
| 4 | Ethanolamine |
| 5 | Triethanolamine |

In each example, the amine alone showed no corrosion protection, but the combination with TME did show protection. The following alkylamines were also tested but showed no protection either when used alone or with TME: dibutylamine, diethylene triamine, dimethylamine, ethylene diamine, monomethylamine and trimethylamine.

EXAMPLES 6–9

The experiments of examples 2–5 are repeated in all details except that trimethylolpropane is substituted for trimethylolethane in combination with each amine. Each combination shows utility as a corrosion inhibitor.

We claim:

1. A corrosion inhibitor for mild steel consisting of the combination of a polyol represented by the formula

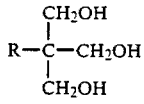

where R is methyl or ethyl with an alkanolamine represented by the formula

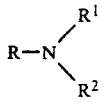

where R can be $HOCH_2CH_2$— or $H_3C$—CHOH—$CH_2$—; $R^1$ can be H, $CH_3$ or $HOCH_2CH_2$—; and $R^2$ can be H, $CH_3$— or $HOCH_2CH_2$—, and $R^1$ and $R^2$ can be the same or different.

2. The combination of claim 1 wherein the polyol is trimethylolethane.

3. The combination of claim 1 wherein the polyol is trimethylolpropane.

4. The combination of claim 1 wherein the alkanolamine is ethanolamine.

5. The combination of claim 1 wherein the alkanolamine is diethanolamine.

6. The combination of claim 1 wherein the alkanolamine is triethanolamine.

7. The combination of claim 1 wherein the alkanolamine is dimethylamino-2-propanol.

8. The combination of claim 1 whereian the alkanolamine is dimethylethanolamine.

9. A method for protecting mild steel from corrosion caused by exposure to water comprising the step of dissolving in the water about 1% by weight of the combination of claim 1.

* * * * *

UNITED STATES PATENT AND TRADEMARK OFFICE

CERTIFICATE OF CORRECTION

PATENT NO. : 4,726,914

DATED : Feb. 23, 1988

INVENTOR(S) : Larry A. Fellows and Paul E. Eckler

It is certified that error appears in the above-identified patent and that said Letters Patent are hereby corrected as shown below:

Column 1, lines 6 & 7, "corrosi-oon" should read -- corrosion --

Column 3, line 3, "trimethyolethane" should read -- trimethylolethane --

Column 4, Claim 1, last line, following the word "different", insert -- wherein the polyol and the amine are in a mole ratio of 0.8 to 1.2 --

Signed and Sealed this

Twenty-seventh Day of September, 1988

*Attest:*

DONALD J. QUIGG

*Attesting Officer*

*Commissioner of Patents and Trademarks*